United States Patent [19]

Miyazaki

[11] Patent Number: 4,863,169

[45] Date of Patent: Sep. 5, 1989

[54] BODY ACTION GAME

[75] Inventor: Kunio Miyazaki, Mibu-machi, Japan

[73] Assignee: Tomy Kogyo Co., Inc., Tokyo, Japan

[21] Appl. No.: 182,293

[22] Filed: Apr. 15, 1988

[30] Foreign Application Priority Data

Apr. 17, 1987 [JP] Japan ..... 62-58219

[51] Int. Cl.[4] ..... A63B 67/14; A63B 67/00

[52] U.S. Cl. ..... 273/109; 273/DIG. 19; 273/1 GA; 446/419; 446/168

[58] Field of Search ..... 273/1 G, 1 GA, 153 R, 273/DIG. 19, 109, 110, 113; 446/419, 170, 168, 202, 204

[56] References Cited

U.S. PATENT DOCUMENTS 1,769,327 7/1930 Wood ..... 446/168
3,109,651 11/1963 O'Donnell ..... 273/109
3,989,255 11/1976 Raffa ..... 273/109
4,335,539 6/1982 Jones ..... 446/204

FOREIGN PATENT DOCUMENTS 1478274 3/1969 Fed. Rep. of Germany ..... 446/168
2436346 2/1976 Fed. Rep. of Germany ... 273/DIG. 19

*Primary Examiner*—Edward M. Coven
*Assistant Examiner*—Gary Jackson
*Attorney, Agent, or Firm*—Staas & Halsey

[57] ABSTRACT

A body action game includes a hose which is flexible to wrap around a player's body in a plurality of convoluted dispositions. A ball dropped into one end of the hose is rolled through the hose until reaching a receptacle or goal attached to the opposite end of the hose. Because of the convolutions in the hose, a player is required to twist and turn in order to manipulate the ball through the hose. A bell mounted in the receptacle is rung by the ball when it enters the receptacle.

12 Claims, 2 Drawing Sheets

BODY ACTION GAME

BACKGROUND OF THE INVENTION

1. Field of the Invention

The present invention relates generally to a game-playing apparatus, and more particularly, to a body action game in which one or more players attempt to pass a ball through a hose convoluted around the player's body.

2. Description of the Related Art

There are no known body action games which employ a hose and ball. However, the concept has been used as one type of children's game wherein a small ball is put into the sleeve of a shirt at one end and is taken out of the sleeve at the opposite end.

While the known game is fun to play, it is limited to a relatively narrow range of age for participants.

SUMMARY OF THE INVENTION

An object of the present invention is to provide a body action game which can be played by participants having a relatively wide range of age.

Another object of the invention is to provide a body action game which is inexpensive to manufacture.

Another object of the invention is to provide a method of playing a body action game to be played by participants having a relatively wide range of age.

Yet another object of the invention is to provide a body action game that tests the manual dexterity and coordination of a player.

The present invention satisfies the aforementioned object by providing a body action game having a hose made of articulated segments, wherein the hose has open opposite ends and a corrugated tubular side wall which makes the hose flexible and expandable. Fittings are provided for securing the hose in a convoluted disposition around a player's body so that a ball placed in one open end of the hose is rolled through the hose around the player's body until reaching a receptacle connected to the other, opposite open end of the hose.

In the course of playing the body action game, a player is required to wrap or convolute and then fix the tubular hose around his or her body using the fittings. The player drops a ball into the open end of the hose opposite the receptacle. This open end becomes the starting portion of the hose and the receptacle is the goal portion. Because the convolutions of hose reverse direction, rolling the ball from one end of the hose to the other is challenging and requires tilting and/or turning of the player's body, and whatever body actions are necessary.

DETAILED DESCRIPTION OF THE PREFERRED EMBODIMENTS

Figure 1:
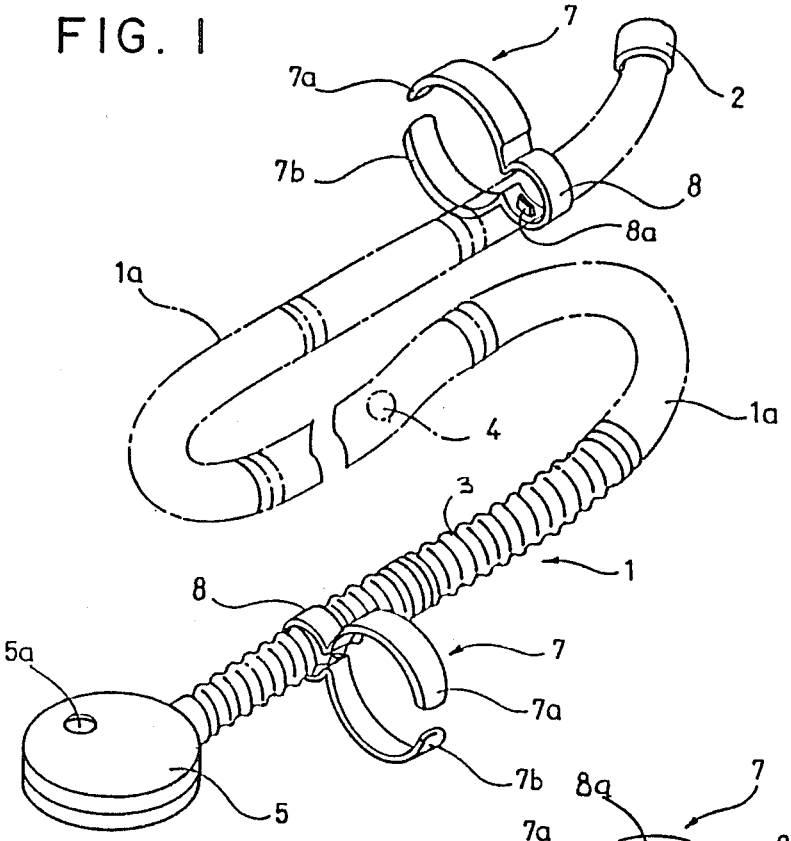
FIG. 1 is a perspective view of a preferred embodiment of the invention.

Referring now to FIG. 1, the body action game of a preferred embodiment of the invention includes a tubular hose 1 having open opposite ends. An end cap 2 is detachably connected to one of the open ends and a receptacle 5 is connected to the opposite open end. The end cap 2 provides a starting portion for the body action game, while the receptacle 5 provides a goal portion whereby a ball 4 is introduced into the hose 1 through the end cap 2 and is rolled through the hose 1 until reaching the receptacle 5.

The hose 1 comprises a plurality of articulated hose segments 1*a* which are coupled together at ends thereof by means of a male-female connection. The articulated hose segments 1*a* form a continuous hose having a tubular, corrugated side wall 3 which, by virtue of the corrugations in the side wall 3 is flexible and expandable. Each hose segment 3*a* is molded into its hollow, corrugated shape out of thermoplastic synthetic resin. The outer shell of each segment 1*a* is corrugated to the extent of taking a bellows-like quality. In other words, the corrugations are deep enough to allow adequate expansion and excellent flexibility so that the hose 1 can be initially convoluted around a player's body and expanded whenever necessary, such as while the player undertakes body actions necessary to roll the ball 4 through the hose 1. The corrugations allow substantially free movement of the player's body while the player is playing the game. The corrugations of the hose 1 also serve to maintain the inner diameter of the hose 1 so that the ball 4 can continue to roll unrestricted through the interior of the hose.

The body action game includes a plurality of fittings 7 which are detachably connectable to the hose 1 at positions along the hose appropriate for fixing the hose to a player in desired positions. Each fitting 7 is made of an elastic synthetic resin and is molded in one piece. The one-piece fitting 7 includes a ring 8 which fits around the side wall 3 of the hose 1, and opposite arcuate arms 7*a* and 7*b* which are used to secure the hose 1 to a player's body.

Figure 2:
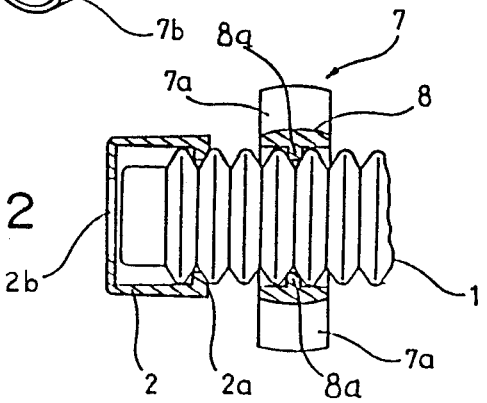
FIG. 2 is a side elevational view, partly in section, showing one end portion of the embodiment of FIG. 1.

Referring to FIG. 2, each fitting 7 further includes a protrusion 8*a* on the inner peripheral surface of the ring 8. The protrusion 8*a* fits between adjacent corrugations of the hose 1 and acts to maintain the position of each fitting 7 along the hose 1. While the fitting 7 is a preferred means for fixing the hose 1 in position with respect to a player's body, other means may be employed, such as, an elastic band having a relatively small loop for connecting the elastic band to the hose and a relatively larger loop for connecting the band and hose to a player's body. It is also acceptable to paste a double-faced fastener, which is fitted on cloth, to the side wall 3 of the hose 1.

End cap 2 is fitted to one of the open ends of the hose 1. As shown in FIG. 2, the end cap 2 is provided with a jaw portion 2*a* provided at a rear side of the cap 2 which is fitted between adjacent corrugations of the hose 1. An opening 2*b* is provided in a forward side of the end cap 2 and has a diameter sufficient to allow passage of a ball 4 therethrough.

Figure 3:
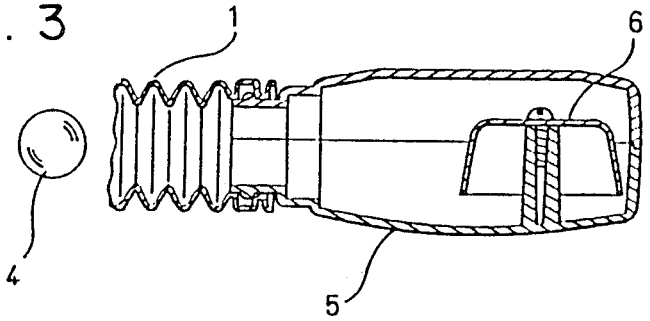
FIG. 3 is a cross-sectional view showing an end portion of the embodiment of FIG. 1 which is opposite the end portion shown in FIG. 2.

Referring to FIG. 3, the receptacle 5 is preferably made of molded plastic. The receptacle 5, which is preferably formed into axially split halves, has a bell 6 mounted within the receptacle 5 which is rung by a ball 4 which has travelled the length of the hose 1 and reached the goal portion. The receptacle 5 has an opening 5*a* (see FIG. 1) for removing the ball 4 after the bell is rung. The bell serves to notify the player that the ball has reached the goal portion or receptacle 5. The ball 4 may be made of metal and has a diameter which is smaller than that of the inner diameter of the hose 1. The diameter of the opening 5*a* of the receptacle 5 is larger than the diameter of the ball 4 to allow removal of the ball 4 after it strikes the bell 6.

Figure 4:
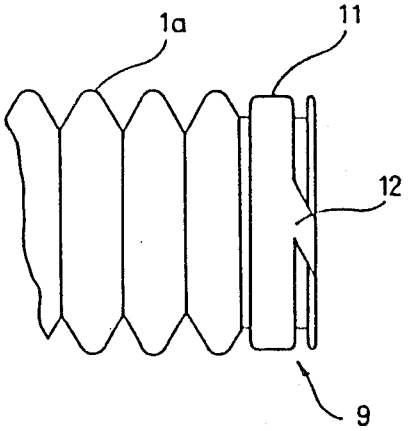
FIG. 4 is a detailed, side elevational view of a female end of a hose segment employed in the embodiment of FIG. 1.
Figure 5:
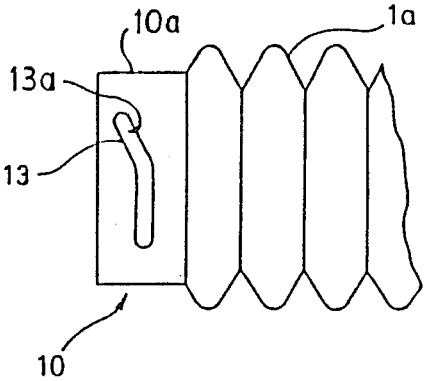
FIG. 5 is a detailed, side elevational view of a male end of the hose segment shown in FIG. 4.
Figure 6:
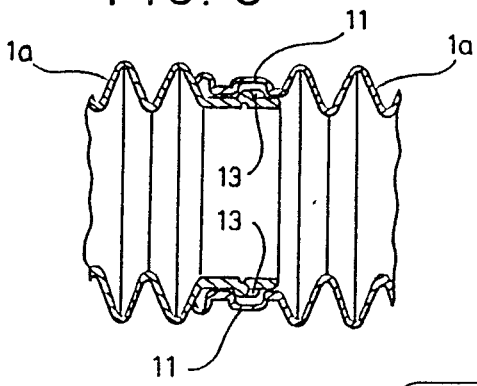
FIG. 6 is a cross-sectional view showing a joint between the male end of one hose segment coupled to the female end of another hose segment.

Referring now to FIGS. 4 through 6, each hose segment 1*a* has a female end portion 9 and an opposite male end portion 10 for coupling together as many hose segments 1*a* as are necessary. The female end portion 9, shown in FIG. 4, includes an annular groove 11 which extends inwardly from an inner surface of the hose segment 1*a* near an end thereof. A branch or angled groove 12 converges with the annular groove 11 at one end and extends outwardly to the end of the hose segment 1*a*.

The male end portion 10 has an annular sleeve portion 10*a* from which a rib 13 extends. The rib 13 has a substantially dog-legged shape which forms a bent portion 13*a* which is angled towards the end of the male end portion 10. To couple together two hose segments l*a*, the male end portion 10 of one hose segment is pushed axially into a female end portion 9 of another hose segment. The rib 13 prevents further axial insertion until the male and female end portions are rotated relative to each other to a point where the bent portion 13*a* of the rib 13 is aligned with the angled groove 12 of the female end portion 9. Further rotation advances the male end portion 10 further inwardly and locks the male and female end portions together by causing the rib 13 to be received in the groove 11, as shown in FIG. 6. The rib 13 actually consists of a pair of diametrically opposed ribs 13, each having a bent portion 13*a* which is aligned with a pair of diametrically opposed angled grooves 12.

Figure 7:
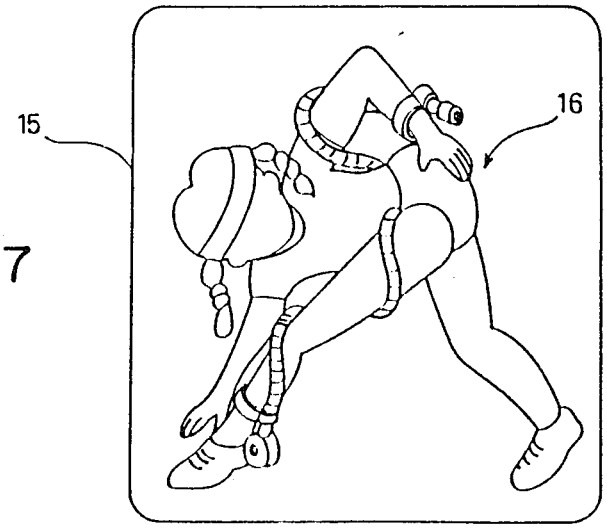
FIG. 7 is a top view of a card having a pattern indicating a required position of the hose for a player.

Referring to FIG. 7, a card 15 is illustrated as one of a plurality of cards which may be used as an accessory to play the body action game. A pattern 16 printed on the card 15 illustrates a required disposition of the hose 1 for a player playing the game. Other cards would have other patterns displaying other dispositions of the hose. The player selects one of the plurality of cards, either optionally or randomly, and then proceeds to roll the ball from the end cap 2, which is the starting portion, through the hose 1 until reaching the receptacle 5, which is the goal portion.

Numerous modifications and adaptations of the body action game of the present invention will be apparent to those so skilled in the art and thus, it is intended by the following claims to cover all such modifications and adaptations which fall within the true spirit and scope of the invention.

What is claimed is:

1. A body action game comprising:

a hose having a side wall and open opposite ends, the hose being flexible and wrappable around a player's body in a plurality of convoluted dispositions, with one open end being higher than the other end, a ball insertable into the higher open end of the hose, and a receptacle attached to the opposite, lower open end of the hose and having an inner chamber for receiving the ball after being moved through the hose by body action of the player.

2. A body action game according to claim 1, further comprising:

a bell mounted in the chamber of the receptacle, the bell being rung by the ball when the ball enters the chamber.

3. A body action game according to claim 1, further comprising:

an end cap having an opening therethrough and being detachably connected to the hose at the upper end of the hose.

4. A body action game according to claim 1, further comprising:

fixture means, detachably connected to the hose, for fixing the hose in the plurality of convoluted dispositions with respect to a player's body.

5. A body action game according to claim 4, wherein the fixture means comprises:

at least one fixture having a ring portion for connecting the fixture to the hose and an arm portion for connecting the fixture and hose to a player.

6. A body action game according to claim 1, wherein the hose has an expandable length.

7. A body action game according to claim 6, wherein the side wall of the hose is corrugated.

8. A body action game according to claim 6, wherein the hose comprises:

a plurality of articulated hose segments, and means for coupling the plurality of hose segments end-to-end.

9. A body action game according to claim 8, wherein each hose segment has a corrugated side wall and open opposite ends.

10. A body action game according to claim 9, wherein each hose segment has a male end portion and an opposite female end portion, and wherein the coupling means comprises the male end portion of one hose segment and the female end portion of another hose segment.

11. A body action game according to claim 10, wherein each male end portion includes an annular sleeve having a rib formed thereon, and wherein each female end portion includes an annular groove spaced inwardly from the end of the hose segment having the female end portion and an angled groove converging with the annular groove, the angled groove extending outwardly to the end of the hose segment, and wherein the rib is receivable in the annular groove.

12. A method for playing a body action game comprising:

wrapping a hose in a convoluted disposition around a player's body, the hose having opposite open ends, one being higher than the other, dropping a ball into the higher end of the hose, and manipulating the ball through the hose by player body action until the ball reaches a goal provided at the opposite, lower end of the hose.

* * * * *